United States Patent [19]

Di Santo et al.

[11] Patent Number: 4,746,917

[45] Date of Patent: May 24, 1988

[54] METHOD AND APPARATUS FOR OPERATING AN ELECTROPHORETIC DISPLAY BETWEEN A DISPLAY AND A NON-DISPLAY MODE

[75] Inventors: Frank J. Di Santo, North Hills; Denis A. Krusos, Lloyd Harbor, both of N.Y.

[73] Assignee: Copytele, Inc., Huntington Station, N.Y.

[21] Appl. No.: 885,538

[22] Filed: Jul. 14, 1986

[51] Int. Cl.[4] ..... G09G 3/00

[52] U.S. Cl. ..... 340/787; 340/805; 350/362

[58] Field of Search ..... 340/787, 784, 785, 788, 340/805; 350/362

[56] References Cited

U.S. PATENT DOCUMENTS

| | | | |
|---|---|---|---|
| 3,655,267 | 4/1972 | Forlini | 350/362 |
| 4,041,481 | 8/1977 | Sato | 340/787 |
| 4,187,160 | 2/1980 | Zimmermann | 340/787 |
| 4,525,710 | 6/1985 | Hoshi et al. | 340/784 |

FOREIGN PATENT DOCUMENTS

| | | | |
|---|---|---|---|
| 0024497 | 2/1977 | Japan | 340/787 |

*Primary Examiner*—Gerald L. Brigance
*Assistant Examiner*—Jeffery A. Brier
*Attorney, Agent, or Firm*—Arthur L. Plevy

[57] ABSTRACT

There is shown a method and apparatus for operating an electrophoretic display. The display is operated in a first mode where essentially it operates as a display having normal DC voltages applied to its electrodes. During a non-display mode, a suitable alternating voltage of a given frequency and magnitude is AC coupled to the anode electrode of the display for a predetermined time interval to cause pigment particles to settle between the anode and cathode whereby the effective life of said display is increased. The transfer of the display mode to the second mode is afforded by suitable switching circuitry.

15 Claims, 1 Drawing Sheet

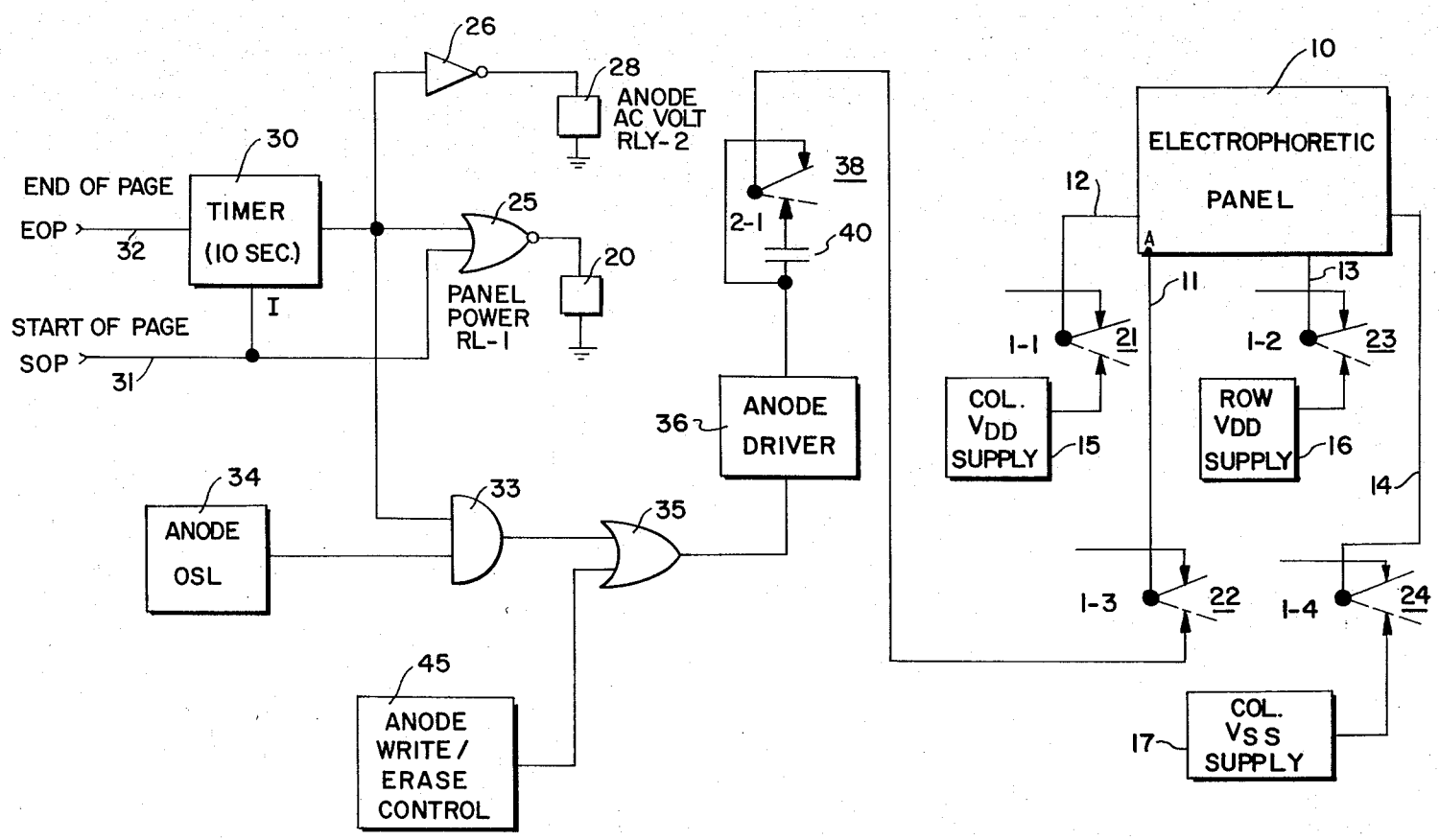
ELECTROPHORETIC PANEL
10
A
11
12
13
14
1-1
1-2
1-3
1-4
21
22
23
24
COL. VDD SUPPLY
15
ROW VDD SUPPLY
16
COL. VSS SUPPLY
17
2-1
38
40
ANODE DRIVER
36
35
33
ANODE AC VOLT RLY-2
28
20
25
PANEL POWER RL-1
26
TIMER (10 SEC.)
30
I
ANODE OSL
34
ANODE WRITE / ERASE CONTROL
45
END OF PAGE
EOP
32
START OF PAGE
SOP
31

METHOD AND APPARATUS FOR OPERATING AN ELECTROPHORETIC DISPLAY BETWEEN A DISPLAY AND A NON-DISPLAY MODE

BACKGROUND OF THE INVENTION

This invention relates to electrophoretic displays in general and more particularly to a method and apparatus for increasing the life and response of such a display.

The prior art is replete with many references which teach and explain the operation of electrophoretic displays. Essentially, an electrophoretic display consists of a suspension of pigment particles dispersed in a dyed solvent of contrasting color. The solvent, as well as the particles, is injected into a cell which basically consists of two parallel and transparent conducting electrodes designated as the anode and cathode. Many such cells also employ a grid electrode which further controls the transportation of charged particles. In operation the charged particles are transported and forced against one electrode as the anode or cathode under the influence of an applied electric field so that the viewer may see the color of pigment which forms a desired pattern.

When the polarity of the field is reversed, the pigment particles are transported and packed on the opposite electrode. In any event, as indicated, the prior art is cognizant of such devices as well as undesirable effects in the operation of such devices. As the prior art understood, agglomeration and clustering are two natural phenomena which are associated with electrophoretic displays. As the resolution and speed of operation increases, these and other phenomena limit problems substantially effect the speed of operation as well as the life of the display. Agglomeration occurs when the particles in the suspension are forced into close proximity such as occurs when the pigment is compressed onto an electrode. Clustering occurs due to fluid motion within the cell and is accentuated as the fluid is switched back and forth since the particles migrate laterally which results in voids in the display.

Both phenomena have been considered by the prior art and have yet to be satisfactorily resolved by any of the prior art techniques. In order for a better understanding of these phenomena, reference is made to an article which appeared in the *Journal of Applied Physics,* September 1978 and entitled "The Understanding and Elimination of Some Suspension Instabilities in an Electrophoretic Display" by P. Murau and B. Singer pages 4820 to 4829. Other articles have been published which generally described the operating techniques and phenomena related with electrophoretic displays. See for example an article entitled "Electrophoretic Display Technology" by Andrew L. Dalisa, published in the *IEEE Transactions on Electron Devices,* July 1977. As one can understand from such prior art articles and other sources, the two primary sources of instability in such displays are agglomeration and clustering.

Pigment agglomerates, in suspension, occur when an insufficient barrier exists between pigment particles. Pigment agglomeration also occurs when pigment particles are packed tightly against an electrode such as occurs during the display mode of an electrophoretic cell. According to the prior art teachings, the cause of agglomeration in suspension can be eliminated with the use of certain copolymers. As far as clustering is concerned, this is caused by fluid disturbances in the vicinity of moving particles during transit in a cell. The size and pattern of these clusters are closely related to the amount of background charge in the suspension. The excess background charge consists of ionic charge carriers which differ in mobility. The slower moving charge carriers are found to cause turbulence which lead to pigment clusters. In any event, the prior art while cognizant of both phenomena did not formulate a successful solution to both problems. As the resolution increases, these phenomena reduce the effective life of the display and adversely affect the speed of operation.

In order to attempt to solve the phenomena of agglomeration, the prior art operated an electrophoretic display which was driven by a drive signal wherein the drive signal is modulated by an alternating voltage signal superimposed on the dirve signal and having a frequency sufficiently high to prevent observation.

This approach did not solve the clustering problems and further affected the quality of the implemented display. See U.S. Pat. No. 4,187,160 entitled Method and Apparatus for Operating an Electrophoretic Indicating Element, issued on Feb. 5, 1980 to A. Zimmermann. Furthermore, as the resolution and speed of operation of such displays increases then particle inertia affect the quality of life of the display.

It is therefore an object of the present invention to provide a method and apparatus for controlling the phenomena in an electrophoretic display.

It is a further object of this invention to control these phenomena associated with an electrophoretic display by utilizing an AC waveform of an appropriate frequency and wave shape and applying the waveform between the anode and the cathode electrodes until the pigment associated with the display is essentially suspended in the fluid medium and therefore not attached to any electrode. When this condition occurs, power is then removed and the pigment will remain in suspension until the panel is again activated by the necessary voltages to permit the display to operate accordingly.

BRIEF DESCRIPTION OF THE PREFERRED EMBODIMENT

A method of operating an electrophoretic display during a non-display mode to increase the life and to obtain better resolution from said display, said display of the type having an anode electrode and a cathode electrode, comprising the steps of applying an alternating voltage for a predetermined time between the anode and cathode electrodes during said non-display mode of a magnitude and frequency to allow electrophoretic pigment particles to be suspended between said cathode and anode.

BRIEF DESCRIPTION OF THE FIGURE

The sole FIGURE is a block diagram depicting a switch circuit for operating an electrophoretic display in a display mode and for applying an AC voltage to the display in a non-display mode.

DETAILED DESCRIPTION OF THE INVENTION

Essentially, as shown in the sole Figure, there is an electrophoretic panel 10. Electrophoretic panels as panel 10 are fairly well known. Such panels, as indicated previously, consist of a suspension of colored charged pigment particles which are usually suspended in a dye solvent of contrasting color. The charged particles are transported and packed against one electrode under the influence of an electric field to produce a desired pattern.

Operation of certain electrophoretic panels, can be analogous to the operation of a vacuum tube triode. Hence such panels include an anode and a cathode electrode with a grid electrode to allow for the selective transfer of the pigment particles between the anode and cathode upon application of a suitable electric field. For one example of a typical panel, reference is made to a co-pending application Ser. No. 670,571, now U.S. Pat. No. 4,655,897, entitled Electrophoretic Display Panels and Associated Methods filed on Nov. 13, 1984 for Frank J. DiSanto and Denis A. Krusos, the inventors herein and assigned to the assignee herein.

As shown in the FIGURE, the electrophoretic panel 10 is associated with a number of electrodes such as 11, 12, 13 and 14. These electrodes comprise the anode, cathode and grid. For example, electrode 11 is the anode electrode, while electrodes 12 and 14 are the column electrodes or grids with electrode 13 being the cathode electrode. As is indicated, the electrodes as the anode, cathode and grid are normally maintained at suitable DC biases during the operational mode or display mode of the electrophoretic panel 10. These biases are supplied respectively by suitable biasing supplies indicated as a column supply (VDD) 15, a row supply 16, and an auxiliary column supply (VSS) 17. In such a display mode the cathode is positive with respect to the grid electrode. The structure and operation of such displays, as indicated, is specified in the above-noted co-pending application.

As seen in the FIGURE, each of the electrodes are coupled to an arm of a contact associated with an electromechanical relay device. In the position shown in the drawing, the electrodes are maintained at a non-operating potential or are opened thus placing the electrophoretic display in a non-power consuming mode. When the relay coil 20 is operated, the associated contacts are placed in the dashed line position whereby the electrodes are then connected to the various supplies for applying operating potential to the display 10.

As will be explained, there are two relays which control operation of the panel and which are used to implement writing and erase control in the display mode and to apply AC potential to the electrophoretic panel in a second or non-display mode where in the second mode the electrophoretic panel is idle. Shown in the FIGURE are two relay coils, namely, coil 20 and coil 28. Relay coil 20 is associated with the contacts 21, 22, 23, and 24. While there are other types of relays that may be employed such as solid state devices, it is indicated that electromechanical or reed relays are preferred due to the extremely high impedances associated with such displays. Hence when coil 20 is energized via the OR gate 25, the contacts 21–24 are operated in the dashed line position. The relay coil 20 is referred to as the panel power relay or RL 1 with the appropriate contacts as contact 21 also designated as 1—1, contact 22 as 1–3 and so on to further indicate that the operation is under control of relay coil 20 or RL-1.

Relay coil 28 is designated as the anode AC voltage relay or RLY 2. Relay coil 28, when energized, operates a single contact as contact 38 which as will be explained causes an AC potential to be applied to the anode electrode of the electrophoretic display. As indicated and as will be further explained, this AC potential operates to transport the pigment particles between the anode and cathode so that the pigment essentially is suspended in the fluid medium and hence, due to the AC potential is not attached to any particular electrode. Hence when power is removed, the pigment particles remain in suspension between the anode and cathode until the panel is again activated by the necessary voltages to permit the same to operate as a display.

By applying this AC potential during selective periods, one can virtually eliminate both the agglomeration and clustering problems which plagued the prior art.

Referring again to the FIGURE, there is shown a relay driver 26 which has its output electrode connected to the coil 28. The input electrode of the driver 26 is connected to the output of a timer 30 with one output of the timer 30 also connected to one input of an OR gate 25. The timer 30 is a conventional timing circuit which by way of example provides an output for a 10 second interval when activated. many examples of suitable timing circuits are known in the prior art. The other input of OR gate 25 is connected to a start-of-page lead 31 while the timer has its input electrode controlled by an end-of-page signal 32. As will be explained subsequently, the end-of-page signal allows the ten-second timer to commence operation to start a sequence of events, as will be explained subsequently.

Also shown in the FIGURE is an AND gate 33. The function of AND gate 33 is to enable the output of anode oscillator 34 to be applied via gate 33 and gate 35 to the input of an anode driver or amplifier 36 during operation of the timer 30. Hence in one mode the output of the oscillator 34 is applied to the anode electrode of the electrophoretic display. The output of the anode drive 36 is connected to contact 38 of relay coil 28 and, as indicated and as shown, normally applies a DC voltage to the anode electrode during the display operation mode. During a second mode, the display is not operating and the output waveform of oscillator 34 is AC coupled to the andoe electrode via the capacitor 40.

Essentially, the output of the anode driver 36 is DC coupled to the upper position of contact 38 in the display mode. This is when relay coil 21 is not operated. The output of the anode driver is also AC coupled to the lower position of contact 30 via a capacitor 40. The capacitor 40 allows the AC voltage to be applied via contact 22 to the anode electrode of the electrophoretic panel 10. Also shown is the power supply or the anode write-erase control supply 45. The output of this supply is supplied via gate 35 to the input of the anode driver 36 to allow the anode to be properly biased for write-erase control and to be so biased during normal display operation.

The circuit operates as follows. The electrophoretic panel 10 is normally accessed to operate as a display as is conventionally known. Hence the electrophoretic panel 10 may display alpha numeric numerals or any type of graphic data as is normally required from the display during operation. In order to engage the circuit in a display operation, a start-of-page signal is supplied to lead 31. The start of page signal specifies that the display 10 is to be operating in the display mode. Hence when a signal appears on line 31, the ten-second timer or timer 30 is inhibited. Such timers as 30 exist whereby an input signal on the inhibit lead (I) will terminate the timing cycle. The gate 25 which is an OR gate is activated by the start-of-page signal and hence relay coil 20 is energized. When relay coil 20 is energized, contacts 21 through 24 are all operated in the dashed line position, thus applying operating potential to the cathode and grid electrodes of the electrophoretic panel 10. It is, of course, understood that during this time coil 28 is not energized and hence the DC potential which emanates from supply 45 is applied via gate 35 to the anode drive 36 and to the upper position of contact 38 whereby the DC voltage emanating from supply 45 is applied directly to the anode electrode 11 via contact 22.

Hence the display 10 will respond in this display mode to display normal graphic data impressed and will operate as a typical electrophoretic panel. At the end of the message, an end-of-page signal appears at line 32. The following events occur. The end-of-page signal on line 32 activates the timer 30. In turn, the moment the timer is activatdd, relay coil 28 is energized or operated via gate 26, thus activating contact 38 in the dashed line position. In a similar manner the output of the timer 30 also operates coil 20 due to OR gate 25. Hence for the end-of-page signal both relays 20 and 28 are operated. Thus contacts 21–24 are placed in the dashed line position and hence DC potential is applied to the cathode and grid electrodes. In any event, contact 38 is also operated which thereby capacitively couples the output of the anode driver 36 to contact 22 and hence to the anode electrode 11 of the electrophoretic panel 10.

As one can see, upon operation of the ten-second timer, gate 33 is energized. Gate 33 thereby couples the oscillator waveform 34 to gate 35 which applies the same to the anode driver 36. While the anode write-erase control 45 is also coupled to the anode driver, the capacitor 40 prevents any DC component from being applied to the anode electrode 20. Hence during this mode, an AC voltage is applied to the anode electrode. This voltage, having a zero DC value, causes the pigment particles to go into suspension between the cathode and anode. This thereby assures that there can be no pigment particles impacted on either electrode and hence allows all pigment particles to go into complete suspension. The magnitude of this AC voltage is typically between 400–600 volts peak-to-peak at a frequency of 60 HZ. The time duration as indicated is about 10 seconds, but periods of between 5 to 15 seconds would suffice if the peak voltage were raised or reduce. Hence longer periods can be accommodated for lower voltage values and so on. In any event, if during the ten-second time interval, a start-of-page signal appears, the following sequence of events would occur. At the inception of the start-of-page signal, the ten-second timer 30 would be inhibited thus terminating the timing interval. The termination of the timing interval would immediately de-energize relay coil 28. Thus contact 38 would go back to the position shown in the FIGURE thus allowing the anode write-erase control supply 45 to be applied to the anode electrode via gate 35 and the anode driver 36. In the same way gate 33 is no longer energized due to the inhibiting of the timer 30. Therefore, during this mode, the anode oscillator does not couple to the anode electrode and hence the display operates in a normal manner.

Thus as can be seen, the biasing scheme as shown above enables the electrophoretic panel 10 to operate in a normal display mode during energization of relay coil 20. At an end-of-page or during a quiescent time for the panel, the ten-second timer is allowed to operate. This applies an AC oscillator voltage onto the anode electrode which therefore forces the particle pigments to remain in suspension between the anode and cathode. Thus upon completion of a display cycle of the electrophoretic panel 10, the AC waveform of an appropriate frequency and wave shape is applied from anode to cathode until the pigment particles are suspended in the fluid medium and hence are not attached to any electrode. After the timing interval, which as shown in the FIGURE is approximately ten seconds, power is then removed and the pigment particles remain in suspension until the panel is again activated by the necessary voltages to permit it to operate as a display. This activation occurs each time a start-of-page signal is applied to lead 31. Thus the panel automatically goes into the appropriate cycle as soon as an end-of-page signal is received. The AC voltage which emanates from oscillator 34 is applied to the anode electrode of the panel for a suitable interval as for example ten seconds as determined by timer 30.

The frequency utilized in a typical panel was 60 cycles. This is based on a diarylide pigment which was used for the pigment particles in a suitable electrophoretic display. The exact frequency selected is a function of the mass of the pigment particles as well as the charge-mass ratio of the same. Other considerations concern the viscosity of the fluid and so on. It has been determined that frequencies much less than 60 cycles are not sufficient to achieve the desired results. The main purpose of applying the AC signal without any DC component to the anode is to keep the particles in suspension during inactive periods of the display. Hence by forcing the particles to remain in suspension between the anode and cathode, one always assures a proper quiescent condition for the display. It has been determined that by the application of the AC voltage in this manner, one can substantially increase the life of the display while operating the same at higher resolution.

After the timing interval is terminated, relay coil 20 is inactivated and all contacts as 21–24 return to the position shown. It is noted that in this mode the cell does not consume any power.

We claim:

1. A method of operating an electrophoretic display during a non-display mode to increase the life and resolution of said display, said display of the type having an anode electrode and a cathode electrode, comprising the steps of:

applying an alternating voltage of a selected magnitude and frequency for a predetermined time between the anode and cathode electrodes during said non-display mode, said selected magnitude and frequency and said predetermined time being chosen to cause electrophoretic pigment particles in said electrophoretic display to be suspended between said cathode and anode and remain suspended between said cathode and anode during said non-display mode.

2. The method according to claim 1, wherein said alternating voltage is applied at a frequency of about 60 HZ.

3. The method according to claim 2, wherein the magnitude of said voltage is between 400–600 volts peaks-to-peak with said predetermined duration of between 5 to 15 seconds.

4. The method according to claim 1, wherein said magnitude of said alternating voltage is between 400 and 600 volts peak-to-peak for said predetermined duration of 10 seconds and at a frequency of about 60 HZ.

5. Apparatus for operating an electrophoretic display, said display of the type having anode, cathode and grid electrodes for controlling the movement of pigment particles in a suspension to impinge upon said anode or cathode electrode in a display mode, said apparatus comprising:

first selectable logic means coupled to said electrophoretic display electrodes for applying DC operating potentials thereto to enable said display to operate in a display mode, second means responsive to the termination of said display mode for applying to said display an alternating voltage waveform, said alternating voltage waveform having a magnitude, frequency and duration selected to cause said pigment particles in said electrophoretic display to go into suspension between said anode and cathode and remain in suspension therebetween until a display mode is initiated.

6. The apparatus according to claim 5, wherein said alternating voltage waveform is at a frequency of about 60 HZ.

7. The apparatus according to claim 5, wherein said second means includes timing means operative to provide at an output a signal of a predetermined interval and means responsive to said interval for applying said alternating voltage waveform to said display during said interval.

8. The apparatus according to claim 5, wherein said magnitude of said alternating voltage is betwen 400 to 600 volts peak-to-peak.

9. Apparatus for operating an electrophoretic display in a first display mode and a second mode when said display mode is terminated to enable said display to operate at an increased life and resolution, said display of the type employing pigment particles and having a cathode, anode and grid electrode for propagating pigment particles therebetween, said apparatus comprising:

timing means responsive to a first signal indicative of an end of display mode to commence a predetermined timing interal upon receipt of said first signal and including means for terminating said timing interval upon receipt of a second signal indicative of a display mode, first switching means responsive to said second signal to supply operating potential to said anode, cathode and grid electrodes during said display mode, and second switching means coupled to said timing means and operative to supply only an alternating voltage signal to said anode during said predetermined timing interval, said alternating voltage having a magnitude and frequency which in combination with said predetermined timing interval causes said pigment particles to migrate to a position where said pigment particles are suspended between said anode and cathode during said predetermined interval and are retained in suspension until operating potential is supplied to said anode, cathode and grid electrode during said display mode.

10. The apparatus according to claim 9, wherein said first switching means includes an OR gate having one input coupled to the output of said timing means and a second input responsive to said second signal, with the output of said OR gate coupled to the coil of a first relay, to operate said first relay coil during the presence of said predetermined timing interval or during the presence of said second signal, said relay coil associated with a plurality of contacts, ecah one operative to supply DC operating potential to an associated electrode during said display mode, with said anode electrode further directed through an additional contact associated with a second relay coil which second relay coil operates only during said timing interval to remove said DC potential from said anode electrode.

11. The apparatus according to claim 10, wherein said second switching means includes driving means coupled to said timing means and operative to activate said second coil during said timing interval to thereby apply said alternating voltage signal to said anode electrode during said interval.

12. The apparatus according to claim 11, wherein said second switching means includes a source of an alternating voltage signal having an output coupled to one input of an AND gate, with the other input of said gate coupled to the output of said timing means to provide at an output said alternating voltage signal only during said interval, with said output of said gate coupled to said additional contact of said second relay via a capacitor to thereby apply said alternating voltage signal to said anode during said interval without any DC component.

13. The apparatus according to claim 9, wherein said timing interval is between 5 and 15 seconds.

14. The apparatus according to claim 9, wherein said alternating voltage signal has a frequency of about 60 HZ.

15. The apparatus according to claim 14, wherein said alternating voltage has a peak-to-peak magnitude of between 400 to 600 volts.

* * * * *